US005209101A

United States Patent [19]

Finzer

[11] Patent Number: 5,209,101

[45] Date of Patent: May 11, 1993

[54] WORKPIECE MACHINING CENTER OF MODULAR CONSTRUCTION

[76] Inventor: Heinz Finzer, Rheinvogtstrasse 17, W-7880 Bad Saeckingen 11, Fed. Rep. of Germany

[21] Appl. No.: 768,294

[22] PCT Filed: Dec. 27, 1990

[86] PCT No.: PCT/EP90/02320

§ 371 Date: Oct. 7, 1991

§ 102(e) Date: Oct. 7, 1991

[87] PCT Pub. No.: WO91/11278

PCT Pub. Date: Aug. 8, 1991

[30] Foreign Application Priority Data

Feb. 5, 1990 [DE] Fed. Rep. of Germany ..... 4003396
Mar. 29, 1990 [DE] Fed. Rep. of Germany ..... 4010115

[51] Int. Cl.[5] ..... B21J 13/00

[52] U.S. Cl. ..... 72/449; 72/404; 72/472; 29/33 Q; 83/213

[58] Field of Search ..... 72/404, 405, 446, 447, 72/455, 464, 473, 335, 472; 29/34 R, 33 S, 33 Q; 83/255, 405, 213

[56] References Cited

U.S. PATENT DOCUMENTS 4,457,160 7/1984 Wünsch ..... 72/446
4,773,250 9/1988 Miyazaki ..... 72/405

FOREIGN PATENT DOCUMENTS 0119599 7/1988 European Pat. Off. .
2737442 8/1985 Fed. Rep. of Germany .
8404085 8/1985 Fed. Rep. of Germany .
3234981 6/1986 Fed. Rep. of Germany .
2051650 1/1981 United Kingdom .

OTHER PUBLICATIONS

International Search Report regarding PCT/EP88/00935.
"Modulare Hochleistungs-Stanzbiegeautomaten für die just-in-time-Fertigung"-Draht und Band-Stanzen und Biegen.
International Search Report regarding PCT/EP90/02310 and English translation.
International Search Report regarding PCT/EP90/02320 and English translation.

*Primary Examiner*—David Jones
*Attorney, Agent, or Firm*—McAulay, Fisher, Nissen, Goldberg & Kiel

[57] ABSTRACT

Described herein is a drive unit for a machining center of modular construction comprising different work modules with tools which are positively controlled with respect to time, e.g. bending tools, front-feed devices, welding stations, assembly units or the like. The drive unit is constructed as a press which comprises the main drive for the machining center. The drive of adjacent work modules is effected via meshing toothed wheels which bridge the interface planes between the work modules, so that the drive unit can be integrated into the machining center in a space-saving and economical manner.

9 Claims, 4 Drawing Sheets

WORKPIECE MACHINING CENTER OF MODULAR CONSTRUCTION

BACKGROUND OF THE INVENTION

1. Field of the Invention

The invention is directed to a modular machining center comprising various work modules, each of which comprises tools which are positively controlled with respect to time, e.g. punching/bending tools, front-feed devices, welding stations, assembly and the like.

2. Description of the Related Art

Such machining centers are known and are distinguished particularly by the fact that the work modules can be used for multiple functions resulting in extremely economical use. Conventionally, the core element of such machining centers is a punching/bending tool unit which comprises a main drive in a base. The main drive drives a central drive gear which is supported above it in a separate housing; the central drive gear drives a plurality of work units such as bending carriages or slides, cutting punches, welding electrodes etc. in a predetermined sequence with respect to time. The drive of other adjoining work units, e.g. (semi-finished product) front-feed devices or presses, is derived from this main drive, for which purpose more or less bulky drive means are generally required in the area of the interfaces between the work units. Therefore, the attempt was made to accommodate a portion of these drive means in an enlarged base; but this severely limited the possibilities for a modular combination of a plurality of work modules.

Such conventional concepts are known e.g. from U.S. Pat. No. 44 57 160 and from EP 0 119 599 B1 and DE-AS 27 37 442. In all of the known cases, the possibilities for converting the machining center are limited to the exchange of a housing resting on a relatively broad base; relatively costly manipulating devices are required for this purpose which, moreover, require time-consuming manipulation. For example, the conversion of the machining center according to EP 0 119 599 requires a separate transport car having a highly loadable swivel axle, wherein separate means are required for bringing the unit housing to be exchanged into a plane in which it can be coupled to the base. In the machining center according to DE-AS 27 37 442, the exchangeability of the bending units likewise requires an elongated substructure, wherein the plug-in shaft connection more or less severely limits the possibilities of exchanging the work units. An uncoupling of the modules is possible only by means of lateral movement.

Moreover, it has been shown that the main drive frequently reaches the limits of its capacity when all possible coupling points of the module are used up.

As a result of these conventional difficulties in the modular construction and conversion of machining centers, the central drive rim of a classical punch/bending tool unit has begun to be replaced (see DE-PS 32 34 981) by horizontal drive shafts and the work modules to be connected linearly one after the other, wherein a separate main drive block is provided, from which all drive movements are derived. However, the substantial advantage of the central drive rim, which consists in the freely movable arrangement of the bending tool units accompanied by a uniform distribution of power, is forfeited with this concept. Another disadvantage of this concept consists in that conversion steps take up a relatively great amount of time and a relatively great amount of construction space is required for the main drive block, especially since the latter generally has large dimensions so that as many modules as possible can be connected in tandem.

SUMMARY OF THE INVENTION

Therefore, the present invention has the object of providing a drive unit for a machining center of modular construction having different work modules, which drive unit can be integrated into the machining center in a spacesaving and economical manner and the possibility is provided of exchanging work modules quickly and safely without having to move the modules laterally. This object is met where the drive unit is constructed as a press which comprises the main drive for the machining center, and in that the drive of adjacent work modules is effected via meshing toothed wheels which bridge the interface planes ($E_s$) between the work modules.

According to the invention, the main drive of the machining center is integrated in a press. This has the advantage, on the one hand, that the drive is at its maximum output wherever the greatest reserve power is required. As a result of this construction, according to the invention, additional work modules no longer require a separate drive, so that the base of these work modules can be constructed not only in a simpler manner, but with a unit modular dimension. Accordingly, for the first time, the base can also be utilized for purposes of support and transport, so that the exchange of the work modules is greatly simplified and the time required for it is reduced. The base can be grasped and handled, together with the module housing resting on it, by means of a fork lift, wherein the cut out portions at the base contribute to a favorable distribution of weight. As a result of the complete exchange of the base, it is also no longer necessary to take special steps to bring the work module into the correct work plane. The latter is already fixed when the base is set down as a result of the unit modular dimension. The direct transmission of power, via meshing toothed wheels, to work modules which are to be coupled still allows the work modules to be constructed with a central drive rim and its advantages to be fully utilized. The transmission of the drive movement from the press to the adjoining modules on the one hand and possibly between the individual work modules on the other hand via meshing toothed wheels enables a maximum flexibility in the composition and conversion of the machining center, wherein it is particularly important that each work module can be exchanged separately without having to handle or move the other modules for this purpose. Accordingly, as distinct from the prior art, it is no longer necessary, when converting the machining center, to undo the combination of individual components in order to reach the individual unit to be exchanged. The sequence of the tandem arrangement of the different work modules also no longer has an effect on the time required for converting the machining center to the extent that it did previously because any desired work module can take the place of the work module to be exchanged as a result of the unit modular dimension of the base in that the modules can be moved away and taken out without involving the other modules. This results in the additional advantage that the driven toothed wheel of the press can be stopped in an exactly defined rotational position at low cost, so that the coupling of the adjacent work module, which is to be operated synchronously with the press, is greatly simplified. This is because the press has exactly defined top and bottom dead-center positions of the press punch which can be made use of for positioning the driven wheel. The adjacent work modules are advantageously equipped with stopping devices by means of which the zero position of the tools relative to one another which occurs when decoupling can be maintained at the respective work modules also during transport.

The development wherein a press comprises the main drive in its base and a drive branch to both sides in its press housing enables a more flexible integration of the main drive in the machining center, thereby simultaneously enhancing the functioning of the press.

A particularly simple movement pattern for coupling and uncoupling the work modules results from the further development wherein the drive type coupling of the work modules is effected via preferably straight-toothed spur gears and the disengaging direction of the modules is aligned parallel to the interface plane $E_S$. For this purpose, it is only necessary to disengage locking devices in the opposite sides of the housing parts and to move away the work module to be exchanged, e.g. vertically relative to the plane of the central drive rim in the horizontal direction and parallel to the center axis of the central drive rim by means of the transporting means, e.g. the fork lift.

The bases of the work modules preferably have the same height as the base of the gear unit housing of the press. The further development wherein the press carries a press stand on a housing base receiving the main drive at which press stand a downwardly open, U-shaped guide part for the press rams is fastened, a counter cutting plate can be screwed directly to the downwardly directed legs of the press rams or, a press bed can be fastened to the latter by means of spacing sleeves. This development ensures via the simplest means that the cutting plane of the press is exactly aligned with the feed-in plane of the adjacent work module even after a possible repeated regrinding of the counter-cutting plate.

BRIEF DESCRIPTION OF THE DRAWINGS

A number of embodiment examples of the invention are explained in more detail in the following with reference to schematic drawings.

DESCRIPTION OF THE PREFERRED EMBODIMENTS

Figure 1:
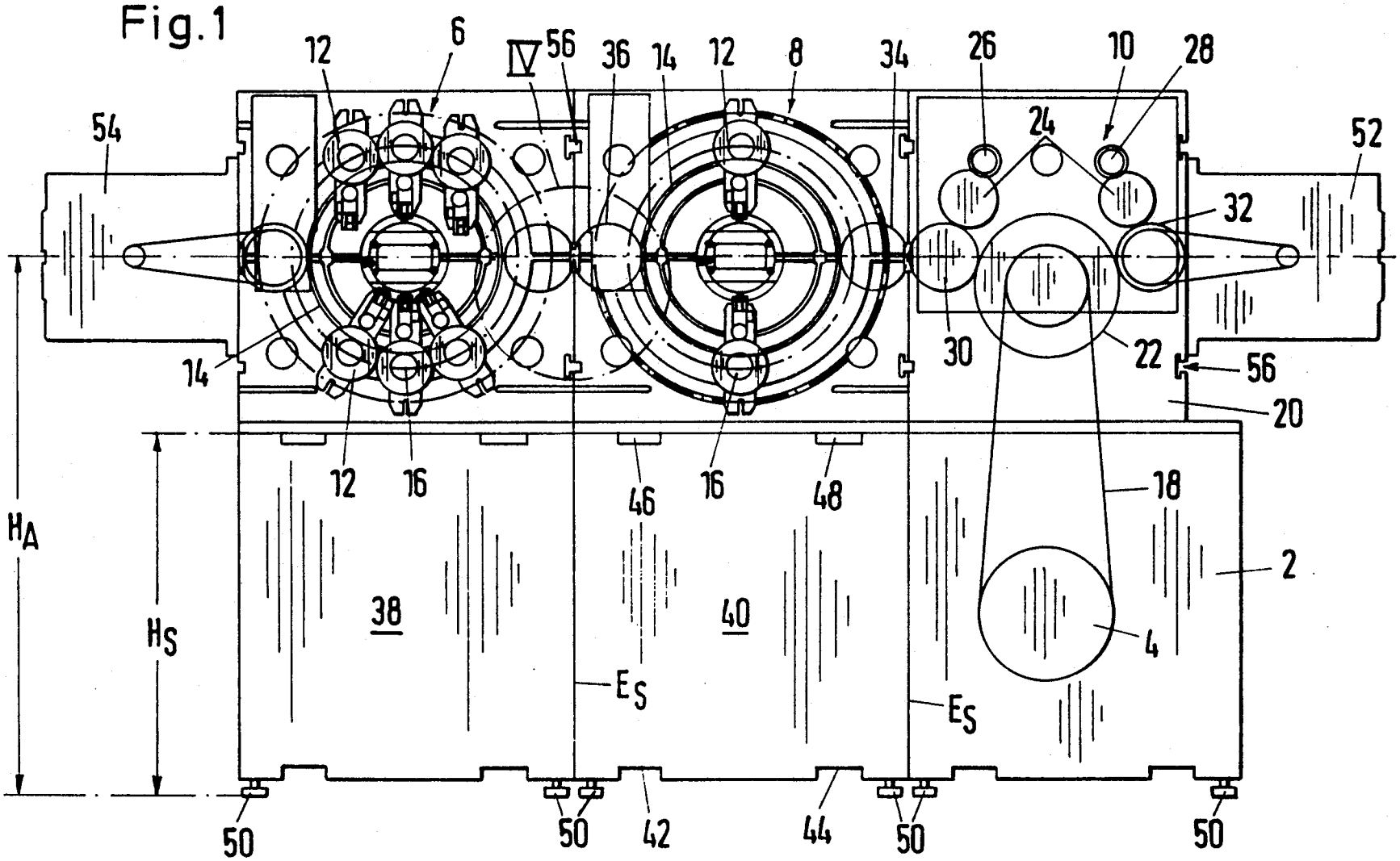
FIG. 1 shows a side view of a machining center of modular construction with a first embodiment form of the drive unit.

The base module of a drive unit receiving the main drive 4 of the machining center is designated in the drawings by reference number 2. The machining center is constructed in a modular manner from three work modules 6, 8 and 10, wherein the work modules 6 and 8 function as punching/bending tool units and work module 10 is constructed as a press. Each punching/bending tool unit 6, 8 carries a plurality of tools 12 which are designed, for example, as bending carriages. Of course, other constructions are also possible, e.g. welding stations or assembly tools.

The tools 12 are positively controlled with respect to time, i.e. they are actuated in a fixed cycle relative to one another; a central drive rim 14 which meshes with corresponding pinions 16 of the tools is used for this purpose.

The work modules 6, 8 do not require their own separate drive. The driving power is derived from the main drive 4 in a manner to be described in more detail in the following:

The main drive 4 is e.g. a component of a press 10 which is constructed as a twin press in the embodiment example. For this purpose, the driving power is directed upward via a chain pull 18 into the area of a press stand 20 in which a main drive gear 22 is supported, the main drive gear 22 being substantially centrally supported. The driving power is transmitted from the latter, via two coupling toothed wheels 30, 32 and intermediate toothed wheels 24, to the two eccentric shafts 26, 28. The drive type connection of the adjoining work modules 6, 8 to the main drive constructed as a press is effected via the coupling toothed wheels 30, 32.

For this purpose, intermediate pinions 34, 36 are assigned to each central drive rim 14, which intermediate pinions 34, 36 can engage directly with the coupling toothed wheels. The meshing of the teeth takes place at the vertical interface planes $E_S$ between the adjacent work modules.

Since the work modules 6, 8 do not require their own drive, the housing bases 38, 40 are constructed so as to be hollow on the inside and they function as a base for the actual work units 6, 8 located above them. This offers the possibility of utilizing the housing bases as transporting and positioning devices for the work units, so that the respective work unit 6, 8 can be removed together with the housing base and replaced with another unit for converting the machining center.

Two bottom recesses 42, 44 and/or two central recesses 46, 48 in which the forks of a transporting means, e.g. a fork lift, can engage, are provided at the work units 6, 8 for this purpose. Advantages result with respect to the distribution of weight particularly when the recesses 46, 48 are used, so that the transporting speed can be increased.

The view according to FIG. 1 also shows that the housing bases 38, 40 and 2 are constructed in a uniform grid, i.e. with the same width, so that the work modules can easily be exchanged with one another. The modules 6, 8 further comprise a base height $H_S$ corresponding to the height of the base module 2 of the press 10. The pinions of the individual modules lie at the same axial height $H_A$ as that of the press 10. Accordingly, it is ensured by simple means that the new work module to be coupled automatically comes to rest at the correct work height, so that the alignment of the pinions is ensured in the simplest manner. A precision level adjustment of the housing can be effected by means of adjustable support feet 50.

Figure 4:
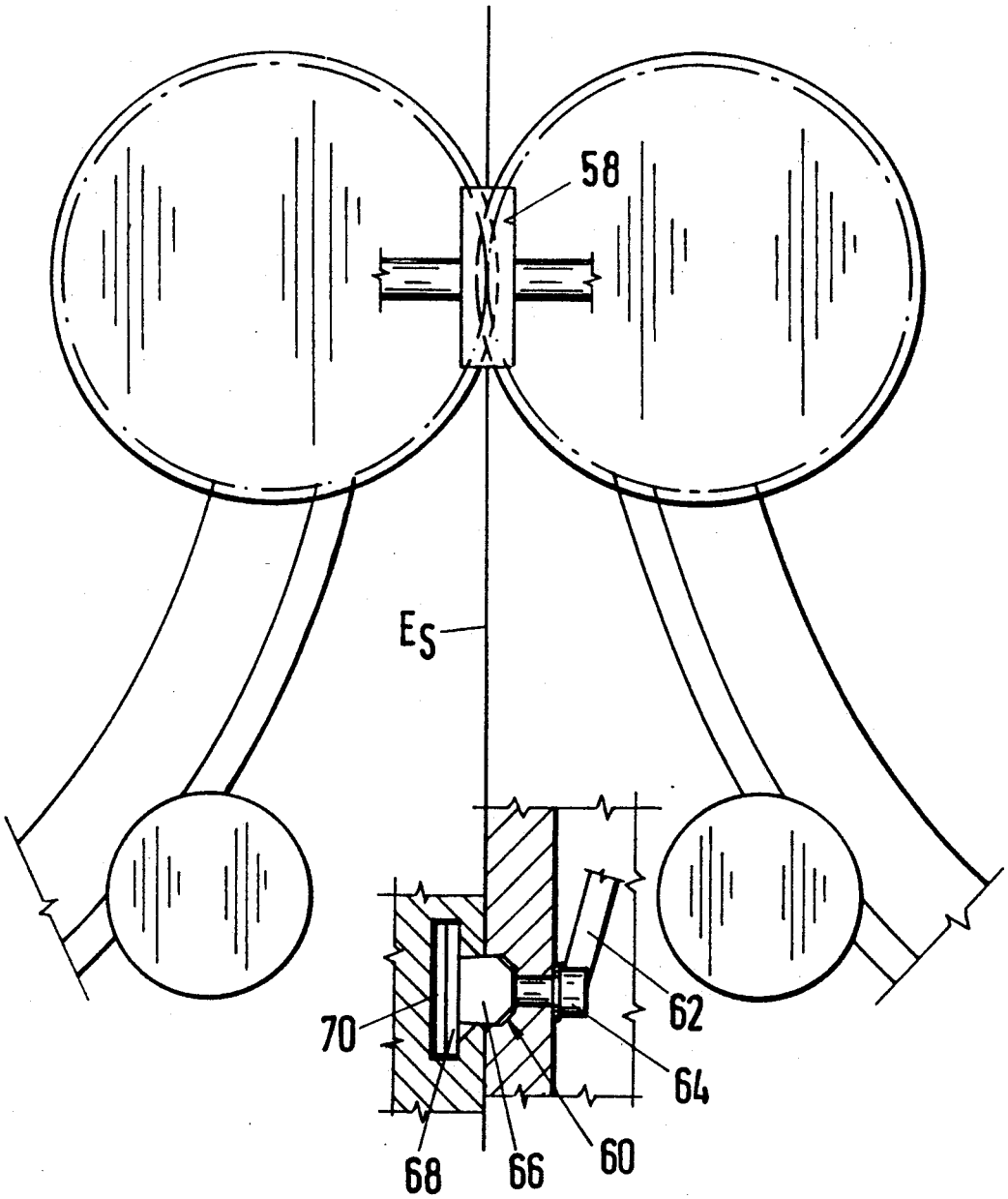
FIG. 4 shows detail "IV" in FIG. 1.

The construction of the machining center, according to the invention, still allows the possibility of connecting additional units to the work modules 6, 8 or to the press 10, respectively, e.g. front-feed devices 52, 54. Centering devices 56 in which sliding blocks can be used are preferably provided in the area of the interfaces to the adjoining units. Detail "IV", according to FIG. 4, shows for the embodiment example that the housing stands of adjacent work modules are provided with recesses 58 in the area of the meshing toothed wheels, which recesses 58 are sealed during the operation of the machining center by cover plates, not shown in more detail, which can take over the function of the centering devices 56. In order to lose as little time as possible for the coupling process, it is preferable to provide in the area of the interface planes a plurality of quick-clamping locking devices 60 which can be actuated by means of a handle 62 which carries a nut 64. The nut 64 engages with a tension bolt 66 which comprises a locking plate 68 at its end, the locking plate 68 being received in an undercut groove 70 of the adjoining work module in a positive-locking manner and so as to have play.

Due to the concept of the machining center of modular construction, according to the invention, the central main drive can accordingly be placed at that point where the highest output capacity is primarily required. Accordingly, in addition to the advantage of favorable distribution of output, there are simultaneously new, previously unusable possibilities for a flexible combination and simple exchanging of the work modules, which can accordingly be equipped in addition with a central drive rim which is advantageous with respect to the power transmission and possibilities for the favorable arrangement of the tools.

As was already mentioned above, an automatic alignment of the reference planes results in the different work modules as a result of the identical construction of all housing bases. In order to keep the feed-in plane of the semi-finished product to be machined, e.g. the wire or sheet metal strips, in exact alignment with the cutting plane 72 (see FIG. 2), a special fastening of the counter-cutting plate 74 at the press stand 20 is provided, which will be explained in more detail in the following with reference to FIGS. 2 and 5 to 7. In these Figures, corresponding structural component parts are provided with identical reference numbers, wherein the elements of the embodiment form according to FIG. 7 include an apostrophe.

The press stand 20 carries a guide part 76, 76' at the front for the press ram 78, 78'. The guide part is constructed in a U-shaped manner and comprises two legs 80 and 82, 80' and 82' which face downward, the counter-cutting plate 74, 74' can be screwed directly on the legs 80 and 82, 80' and 82'. The two legs 80 and 82, 80' and 82' end in the cutting plane 72, and the counter-cutting plate 74, 74' closes the two legs to form a closed frame, so that there is a favorable flow of force from the cutting plate into the press stand.

Figure 6:
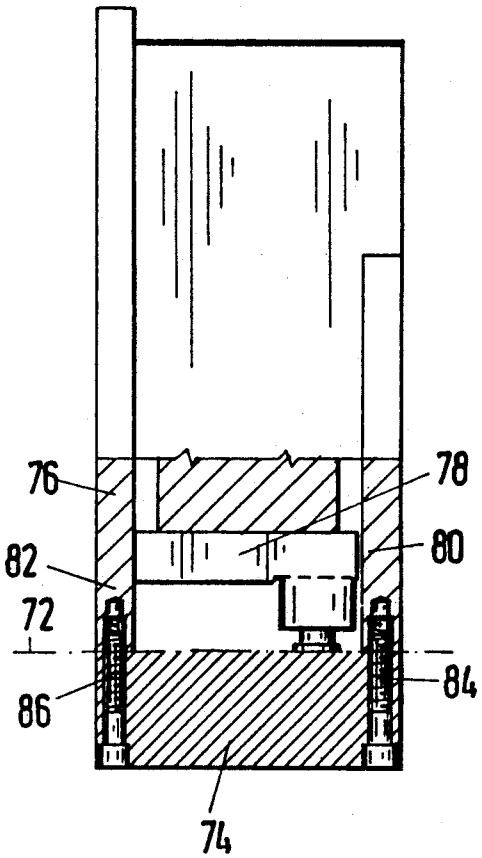
FIG. 6 shows a sectional view according to VI—VI in FIG. 5.

In the embodiment form according to FIG. 6, the counter-cutting plate 74 is screwed directly to the legs 80, 82 by means of screws 84, 86. In the event that a regrinding of the counter-cutting plate should be effected, no additional steps need be taken in order to maintain the position of the cutting plane 72. The latter is permanently established by means of the lower end faces of the legs 80, 82.

Figure 5:
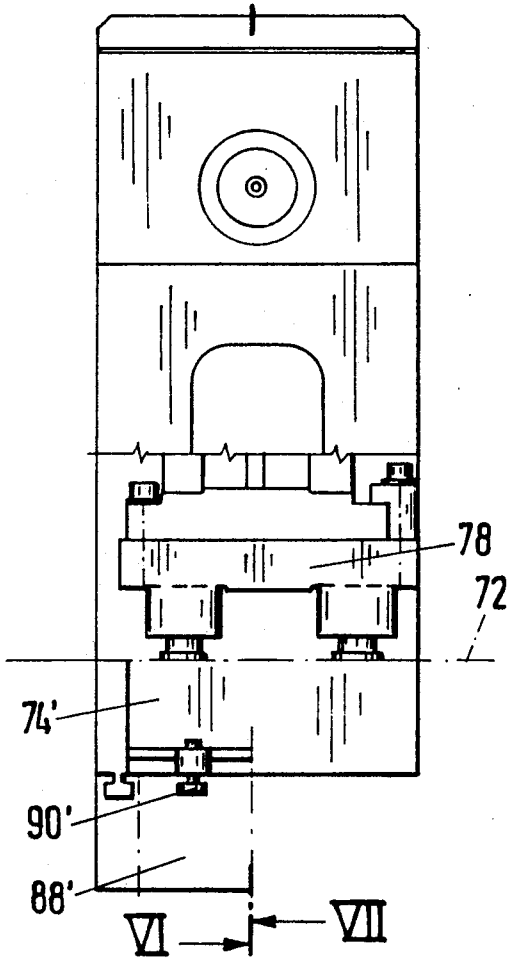
FIG. 5 shows a schematic front view of a punching unit mounted at the press in two embodiment forms.
Figure 7:
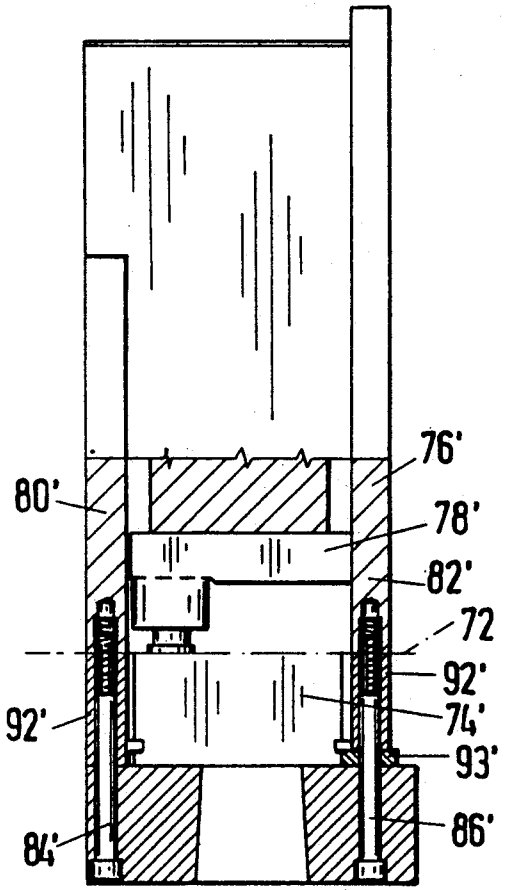
FIG. 7 shows a sectional view according to VII—VII in FIG. 5.

According to FIGS. 5 and 7, the design of the guide part 76' also allows the use of conventional counter-cutting plates 74' which is supported on a press bed 88' with the aid of sliding blocks 90'. In this case, the screw fastening is effected between the press bed 88' and guide part 76' with the intermediary of spacing sleeves 92' and spacing washers 93'. Note, however, it the counter-cutting plate 74' is re-machined the spacers 92', 93' must be worked down by the same amount.

Figure 2:
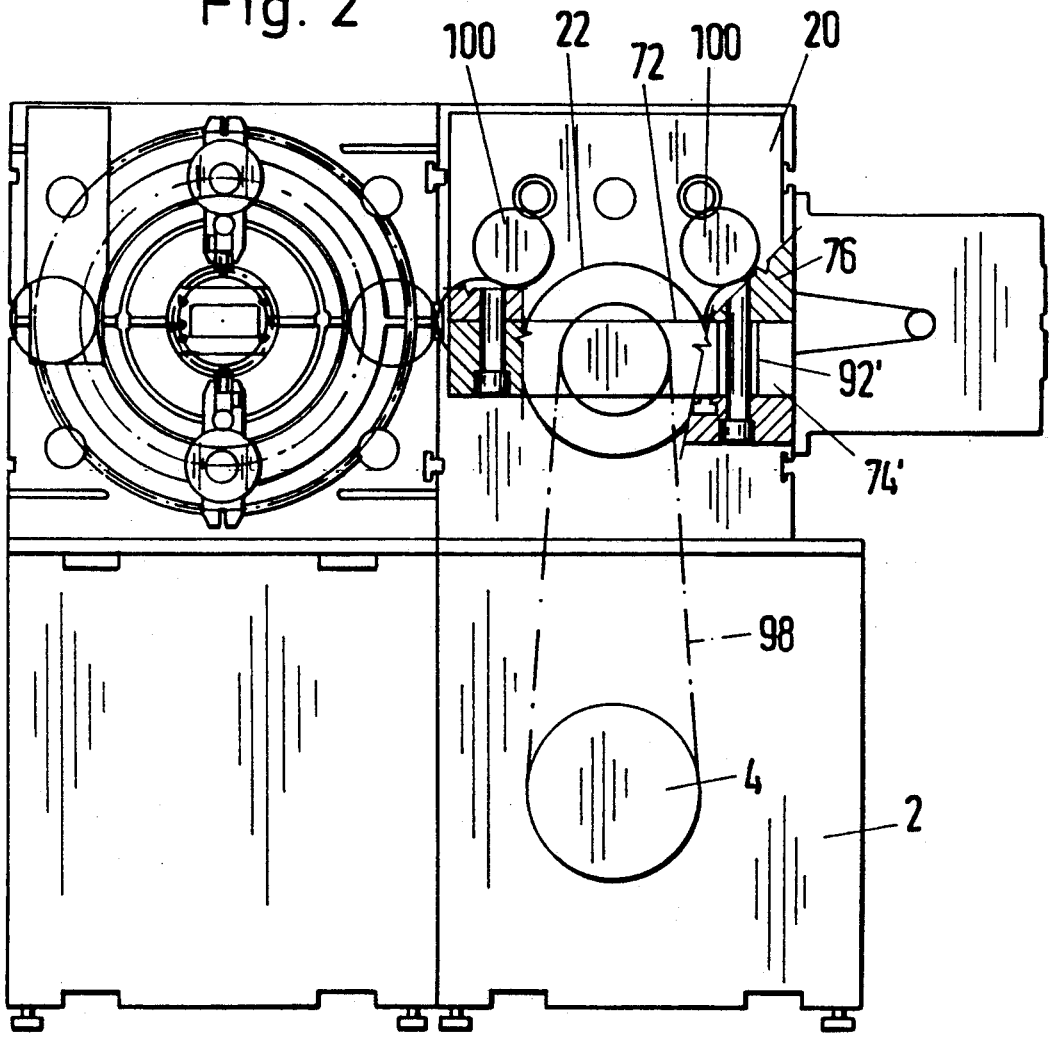
FIG. 2 shows a view of another embodiment form of the drive unit corresponding to FIG. 1 in order to show two variants of the counter-cutting plate support at the press.

The two variants of the fastening of the counter-cutting plates 74, 74' at the press 10 are indicated in FIG. 2 with reference to a somewhat modified construction of the machining center. In other respects the modular construction of the machining center substantially corresponds to that according to FIG. 1. Here also, the driving power is transmitted from the main drive 4 to the main drive gear 22 via a gear unit 98, wherein the drive of the eccentric shafts of the press is again effected via identical intermediate toothed wheels 100 which mesh with identically toothed coupling toothed wheels, so that a synchronized drive of the tool units in the various work modules is ensured. The meshing engagement of the coupling toothed wheels is preferably likewise located in the area of the interface between the base housing 2 and the press stand 20, so that an easy connection of the two structural component parts results.

Figure 3:
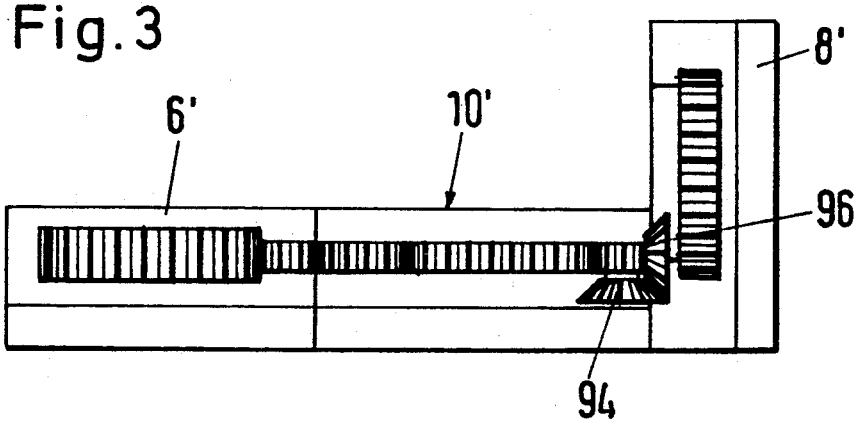
FIG. 3. shows a schematic top view of a machining center with another arrangement of the work modules.

In all the embodiment forms described above the drive type coupling of the work and machining modules with one another and with the press is effected via spur gears. This coupling has the advantage that simple kinematics result for the lifting movement of the work modules when the latter are arranged in a row. In the event that the work modules are arranged at an angle, it is advantageous to effect the drive type coupling via bevel gears 94, 96, which is indicated in FIG. 3. In this embodiment form, the press with the main drive is provided with reference number 10', the adjacent work modules are provided with reference numbers 6' and 8'.

The concept according to the invention allows the machining center to be converted in such a way that a complete work module 6, 8 is constructed at a location remote of the machining center and is exchanged, if necessary, by means of a crudely working transporting device, e.g. a fork lift.

Of course, modifications of the embodiment forms which are shown are possible without departing from the basic idea of the invention. For example, the transmission of drive power can be effected from the press to the work modules via toothed wheels arranged in the corner areas of the adjoining housing cases. A plurality of coupling toothed wheels can also be provided for every interface plane.

What is claimed is:

1. A modular machining center comprising:

(a) a drive module comprising:

(i) a main drive;

(ii) main drive means being driven by said main drive;

(iii) first tool driving gears being driven by said main drive means;

(iv) first system driving gears being driven by said main drive means;

(v) a first tool being driven by said first tool driving means and having a first housing having a first wall; and, (vi) a first base for supporting said first tool; and, (b) a work module comprising:

(i) module driving gears (ii) second tool driving gears being driven by said module driving gears;

(iii) second system driving gears being driven by said module driving gears;

(iv) a second tool being driven by said second tool driving gears and having a second wall; and, (v) a second base for supporting said second tool; wherein, said drive and work modules are positioned so that said first and second walls are adjacent one another, said first and second walls defining a vertical interface plane, and wherein said first system driving gears and said module driving gears are positioned to mesh within said vertical interface plane to drive the modular machining center.

2. The modular machining center of claim 1, wherein said first and second bases having modular dimensions and said second base having openings for engaging a fork lift.

3. The modular machining center of claim 1, wherein said drive module further comprises third system driving gears being driven by said main drive, and wherein said main drive is positioned within said first base.

4. The modular machining center of claim 1, wherein said drive and work modules are equipped with stopping devices which fix zero positions of said tools relative to one another.

5. The modular machining center of claim 1, wherein said first system driving gears and said module driving gears are straight-toothed spur gears and wherein said first system driving gears and said module driving gears are disengaged by moving one of said modules in a direction parallel to said vertical interface plane.

6. The modular machining center of claim 3, wherein said drive means comprises a main drive gear substantially centrally supported within said first housing and wherein said first and third system driving gears comprise an intermediate gear.

7. The modular machining center of claim 1, wherein said first tool is a press having a press stand, press rams and press ram legs and wherein a U-shaped guide part is fastened to said press stand.

8. The modular machining center of claim 7, wherein a counter-cutting plate is fastened to said press ram legs.

9. The modular machining center of claim 7, wherein a press bed is fastened to said press ram legs.

* * * * *